US005622282A

United States Patent [19]

Yazawa et al.

[11] Patent Number: 5,622,282

[45] Date of Patent: Apr. 22, 1997

[54] DOUBLE-WALL AEROSOL CONTAINER

[75] Inventors: Iwao Yazawa, Tokyo; Toshiyuki Mitsui, Saitama-ken; Kazunori Hoshino, Kanagawa-ken, all of Japan

[73] Assignee: Toyo Aerosol Industry Co., Ltd., Tokyo, Japan

[21] Appl. No.: 429,312

[22] Filed: Apr. 26, 1995

[30] Foreign Application Priority Data

Dec. 21, 1994 [JP] Japan ..... 6-318768

[51] Int. Cl.[6] ..... B65D 83/14

[52] U.S. Cl. ..... 222/95; 222/105; 222/389

[58] Field of Search ..... 222/95, 105, 107, 222/394, 402.1, 386.5, 389

[56] References Cited

U.S. PATENT DOCUMENTS

| | | | |
|---|---|---|---|
| 4,095,724 | 6/1978 | Perusco | 222/95 |
| 4,148,416 | 4/1979 | Gunn-Smith | 222/95 X |
| 4,752,018 | 6/1988 | Rudick et al. | 222/95 X |
| 5,031,384 | 7/1991 | Rebeyrolle et al. | 222/95 X |
| 5,167,631 | 12/1992 | Thompson et al. | 222/386.5 X |
| 5,232,126 | 8/1993 | Winer | 222/95 |
| 5,305,921 | 4/1994 | Kock et al. | 222/95 |
| 5,497,911 | 3/1996 | Ellion et al. | 222/95 |

FOREIGN PATENT DOCUMENTS

| | | | |
|---|---|---|---|
| 2-218461 | 8/1990 | Japan | B05B 9/04 |
| 5-32221 | 8/1993 | Japan | B05B 9/04 |
| 6-32863 | 8/1994 | Japan | B05B 9/04 |

*Primary Examiner*—Andres Kashnikow
*Assistant Examiner*—Kenneth Bomberg
*Attorney, Agent, or Firm*—Michael D. Bednarek; Kilpatrick & Cody

[57] ABSTRACT

A double-walled aerosol spray container includes a hollow outer jacket and a flexible bag therein. A substance to be sprayed is held in the bag, while a propellant is charged into a space outside of the bag and within the jacket. The construction of the aerosol spray container helps ensure that the bag does not slip off during manufacture or use thereof. The bag includes a flange about its open end, and the flange abuts an inwardly projecting engagement ridge formed on a corresponding part of the jacket, preferably with an annular packing therebetween. The bag has a storage section that is thinner than the flange, and is easily deflatable or deformable. The aerosol spray container also includes a housing in which a spray valve mechanism is incorporated. The housing includes an inner frame that is inserted into the open end of the bag so that the bag is securely held between the jacket and the housing.

5 Claims, 4 Drawing Sheets

DOUBLE-WALL AEROSOL CONTAINER

BACKGROUND OF THE INVENTION (1) Field of the Invention

The present invention relates to a double-wall aerosol container including of a jacket and an inner bag disposed inside the jacket such that the inner bag communicates with to a nozzle. An aerosol content, which is preferably separate from the propellant, is charged to the inner bag and is adapted to be sprayed without contacting the propellant by pressurizing the inner bag from the outside thereof.

(2) Description of Related Art

In a conventional technique for spraying an aerosol content, a deflatable inner bag is disposed in a jacket of an aerosol container, with a propellant being charged in the space between this inner bag and the jacket so as to prevent the aerosol content from contacting the propellant, and to allow the aerosol inner bag to be pressurized by the propellant to spray the content as an aerosol with the aid of this pressure.

In such a technique, as described in Japanese Utility Model Publication Nos. Hei 5-32221 and 6-32863, and in Japanese Unexamined Patent Publication No. Hei 2-218461, the inner bag is connected to the jacket by an annular engagement ridge formed to protrude inwardly from the inner peripheral surface of the jacket at an upper part of the jacket. The upper part of the inner bag is partly brought into contact with this engagement ridge, and the thus contacted part of the inner bag is pressed against the inner surface of the engagement ridge by the outer circumference of a housing, thus fixing the inner bag relative to the jacket.

That is to say, the fixing of the inner bag to the inside of the jacket according to the prior art, as described above, is achieved by nipping the upper end portion of the inner bag, which is as thick as the thin deflatable storage section between the housing and the jacket, so as to secure the inner bag to hang in the jacket with the aid of this nipping force.

Accordingly, when the inner bag is assembled in the jacket in the production process, it is difficult to engage and retain the inner bag within the jacket, and the inner bag must be retained in the jacket using a special tools and the like. With the inner bag being retained by the tool, the housing must be inserted through the opening of the jacket to allow the upper end portion of the inner bag to be nipped securely between the outer peripheral surface of the housing and the inner peripheral surface of the jacket. This requires additional effort in manufacturing. It is therefore disadvantageous with respect to workability to apply the housing after the inner bag is engaged with the inner peripheral surface of the jacket, as described above.

Under such circumstances, it is also known to secure the upper end portion of an inner bag to the outer peripheral surface of a housing and to attach the resulting housing to the jacket. However, in order to secure the upper end portion of the inner bag to the outer peripheral surface of the housing beforehand, an extra manufacturing step is required for securing the inner bag, and also the procedure of securing the inner bag in the pretreatment step therefore must be considered, requiring more complex manufacturing. In addition, when the inner bag integrated with the housing is inserted into the jacket, the soft inner bag is often inadvertently brought into contact with the rigid housing during that process, damaging the inner bag and disadvantageously requiring an increased number of procedures in the assembly operation.

Further, since the upper end portion of the thin inner bag is conventionally nipped securely between the outer peripheral surface of the housing and the inner peripheral surface of the jacket; even after completion of assembly, the inner bag often breaks at the nipped portion or slips out of position.

SUMMARY OF THE INVENTION

The present invention is diverted to solve the problems described above, and it is an objective of the present invention to enable attachment of an inner bag in a jacket without using any special tools or the like, then enable fitting a housing of an aerosol container in the opening edge of the thus attached inner bag without damaging the inner bag. It is an additional objective to prevent the inner bag from slipping off into the jacket after attachment or from being damaged during use or the assembly process.

A double-wall aerosol container according to the present invention comprises a jacket that has, at the bottom thereof, a charging valve for charging a propellant into the jacket, and also an annular engagement ridge on the inner peripheral surface of the jacket; an annular parking placed to engage the upper side of the engagement ridge of the jacket; an inner bag having a thick flange formed around the opening edge thereof with the aforementioned annular parking being applied on the lower surface of the flange, and also having a storage section, connected to the flange, which ran be deformed or deflated by the pressure of the propellant charged in the jacket; a housing having an inner frame inserted along the inner peripheral surface of the opening edge of the inner bag, and an annular rib formed to protrude from the peripheral surface of the upper end portion of the inner frame and placed on the upper end face of the flange of the inner bag, the housing being also including a valve mechanism; and a cover which is formed by folding inward the upper end portion of the jacket to fix and cover the upper surface of the housing, with a stem of the valve mechanism protruding from the center of the cover.

In this case, the storage section of the inner bag may have a generally tubular form, or may have a plurality of vertical and parallel accordion pleats oriented radially along the peripheral surface thereof. Such a storage section having a tubular form with vertical and parallel accordion pleats oriented radially allows smooth deflation or deformation of the inner bag even when the thickness of the inner bag is subtly uneven. Therefore, the aerosol content is prevented from remaining unused in the inner bag, enabling full and non-wasteful use of the aerosol content.

Since the constitution of the present invention is as described above, the storage section of the inner bag can readily be deformed by the pressure of the propellant. Meanwhile, a flange, which is thicker than the storage section, is formed at the upper part of the inner bag, and an annular packing is disposed under the flange. Accordingly, the annular packing can be brought into engagement with the upper side of the engagement ridge formed on the jacket. Further, in this engagement onto the upper side of the engagement ridge, the inner bag is very stably engaged on the upper side of the engagement ridge because of the thick flange provided on the inner bag.

In assembling the aerosol container the inner bag is inserted into the jacket through the upper opening thereof, so, the flange of the inner bag can be engaged with the upper side of the engagement ridge on the jacket via the annular packing. Thus engagement of the flange of the inner bag with the engagement ridge via the annular packing prevents the inner bag from slipping off into the jacket or out of position, and the inner bag can stably be retained in the jacket.

In a subsequent manufacturing step, the housing is inserted to the upper end opening of the jacket. The housing is provided with a cylindrical inner frame formed at the lower end thereof. The inner frame is then inserted along the inner periphery of the flange of the inner bag, and the annular packing is pressed, with the aid of this pressure of insertion, against the upper side of the engagement ridge formed on the jacket, thus maintaining airtightness.

The annular packing may be fitted partly in an annular groove formed on the outer peripheral surface of the inner bag at a position corresponding to the lower part of the thick flange. The annular packing as inserted such an annular groove will have a stabilized position for mounting the annular packing itself, so that it enhances airtightness. However, if accuracy is secured in assembling the various members, the above-described annular groove is necessarily required.

The annular rib may be placed on the upper end face of the flange of the inner bag via a gasket. Thus, if the gasket is disposed on the upper end face of the flange, the annular rib of the housing can be brought into press contact with this gasket to ensure a good seal at this section. Accordingly, the content is prevented from leaking out through the aerosol contact section between the inner frame and the flange of the inner bag. However, if the flange is made of a soft and elastic material, the flange also serves as the gasket, so that the additional gasket may not always be necessary.

The cover covering the upper surface of the housing can immobilize the valve mechanism, including the stem and stem gasket together, to be housed in the housing, and thus the valve mechanism can be handled as one member in the operation of incorporating the mechanism into the jacket, improving workability.

In the double-wall aerosol container as described above, if the valve mechanism is opened according to a known technique by pushing the stem, the internal space of the inner bag is allowed to communicate to the nozzle for spraying the aerosol content. Since the inner bag is constantly pressurized by the pressure of the propellant charged between the outer peripheral surface of the inner bag and the inner peripheral surface of the jacket, the content in-the inner bag flows into the housing without being containing the propellant and is sprayed out through the nozzle via the valve mechanism. The inner bag can gradually be deformed to reduce its volume as the aerosol content is sprayed continuously.

The thick flange of the inner bag is engaged, via the annular packing, with the upper side of the engagement ridge formed on the jacket, so that engagement of the inner bag with the jacket is secure and preventing the inner bag from slipping into the jacket. Slipping off can also be effectively prevented, not only when the inner bag is inserted into the jacket in the assembly process, but also when these and other final product is used after completion of assembly.

The content of the invention is not limited to the above description, and the objects, advantages, features, and uses will become apparent by reference to the following description, considered in connection with the accompanying drawings. Additionally, it should be noted that any appropriate alterations not departing from the spirit of the invention are to be included in the scope of the invention.

DETAILED DESCRIPTION OF PREFERRED EMBODIMENT

Figure 1:
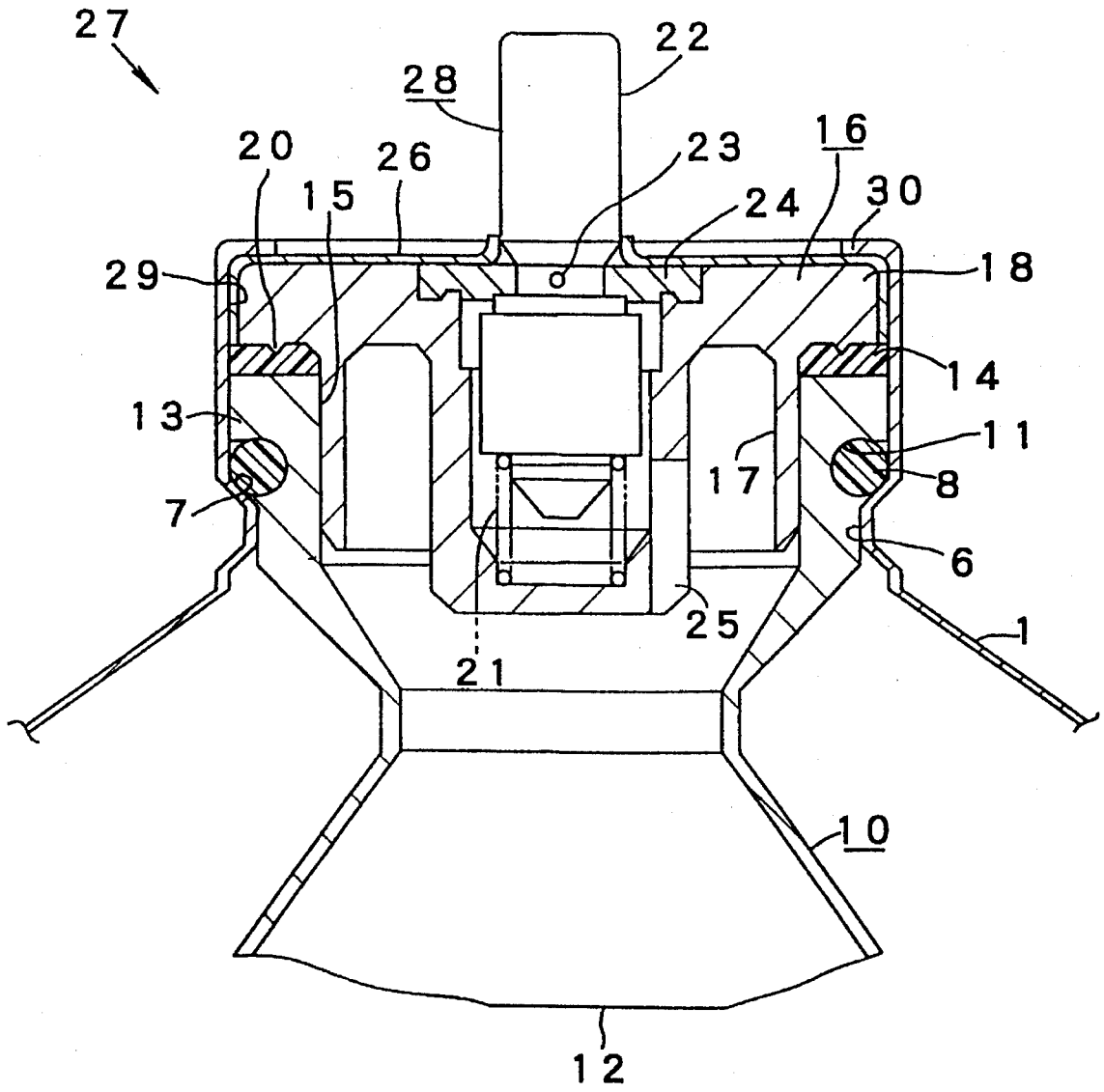
FIG. 1 shows in upper cross-sectional view a double aerosol container according to one embodiment of the present invention.
Figure 2:
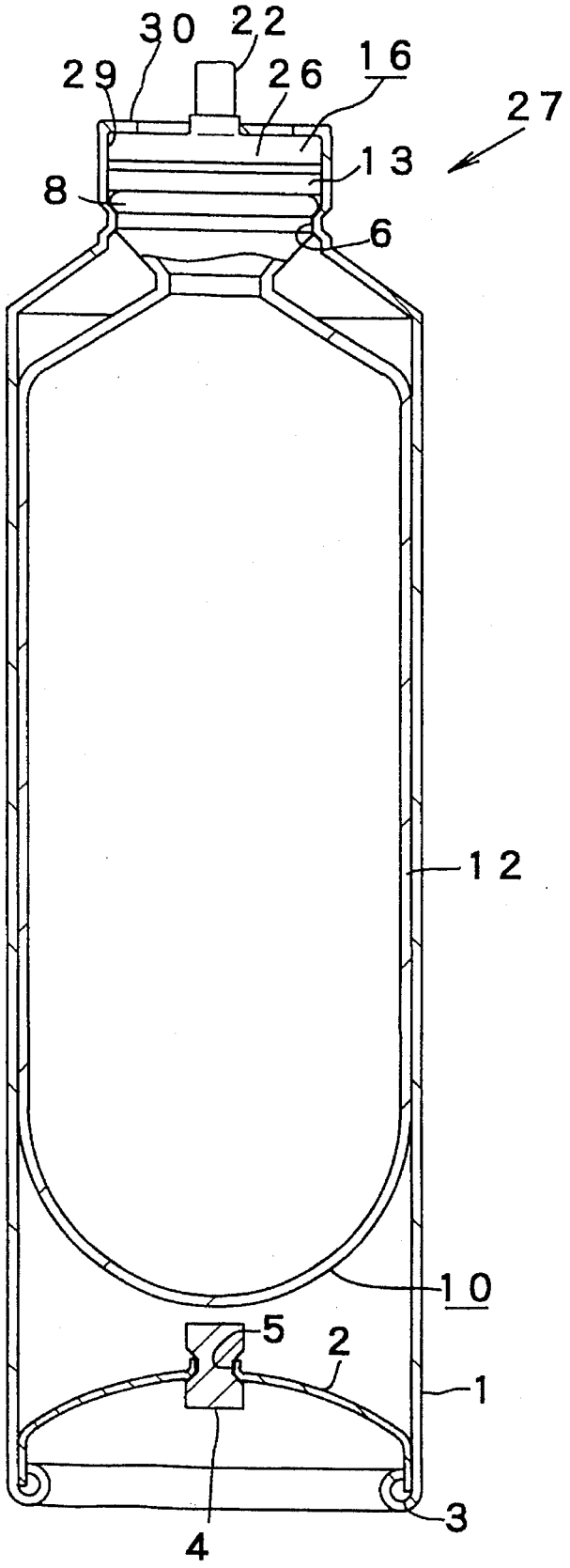
FIG. 2 shows in cross-sectional view an aerosol container according to one embodiment of the invention.

A preferred embodiment of the present invention is now being described in accordance with a preferred embodiment and referring to the attached drawings.

A metallic jacket 1 includes a metallic bottom plate 2 connected and secured to the lower end of the jacket 1 via a rolled edge portion 3.

The bottom plate 2 has at the center thereof a charging valve 4 which is used for charging a propellant into the jacket 1. The charging valve 4 may be made of rubber and is fitted in a charging port 5 defined in the bottom plate 2 immediately after the propellant is charged into the jacket 1 so as to prevent leakage of the propellant. Alternatively, the propellant may be charged using a charging nozzle (not shown) which is allowed to stick through the rubber charging valve 4. After charging, the charging nozzle penetrating the valve 4 may be withdrawn to close the hole formed by penetration of the nozzle by the self restoring elasticity of the rubber charging valve 4. Otherwise, the charging valve 4 may be of any conventional structure such as of a check valve.

An annular engagement ridge 6 protrudes inwardly from the inner peripheral surface of the jacket 1 at an upper part thereof. An annular packing 8, being for example, an O ring, is fitted and applied on the upper side 7 of this engagement ridge 6.

The annular packing 8 is also adapted to be fitted in an opposing annular groove 11 provided on the outer peripheral surface of inner bag 10 at an upper position thereof. By Fitting the annular packing 8 in the annular groove 11, as described above, the annular packing 8 can stably be fitted in position, thereby enhancing in the airtightness of the container. However, the annular groove 8 is not always necessary, provided that the parts can be assembled with sufficient precision.

In addition, the inner bag 10 is also provided, toward the lower end thereof, with an aerosol storage section 12 in which a content is stored. The storage section 12 is formed from, for example, a metal foil such as aluminum foil or a soft and elastic resin film. The storage section 12 may readily be deformed when pressed by the pressure of the propellant charged in the jacket 1. The storage section 12 is formed to have a generally tubular form and has a closed bottom.

Meanwhile, the optionally-provided inner bag 10 is provided with a thick flange 13 formed above the annular groove 11, and the Flange 13 is designed to be engaged stably with the upper side 7 of the engagement ridge 6 via the annular packing 8. Further, a gasket 14 is disposed on the upper end face of the flange 13 of the inner bag 10. However, if the flange 13 is made of a soft and elastic material, this gasket 14 is necessarily required, because the flange 13 also effectively serves as the gasket 14.

An inner frame 17 of a housing 16 is inserted along the inner peripheral surface of the opening edge 15 of the inner bag 10. The flange 13 of the inner bag 10 and the annular packing 8 can stably be pressed against the inner surface of the jacket 1 by the inner frame 17 inserted to the opening edge 15.

Since an annular rib 18 protrudes from the upper end of the housing 16, and its annular rib 18 is placed such that the lower surface is in contact with the upper surface of the gasket 14 (or directly with the flange 13 made of a soft and elastic material), the aerosol content is prevented from leaking out through the contact section between the inner frame 17 and the inner surface of the inner bag 10. An annular protrusion 20 for maintaining airtightness is provided on the lower surface of the annular rib 18, at the contact section between the annular rib 18 and the gasket 14 (or flange 13), in order to further enhance airtightness of the gasket 14 )or flange 13).

A stem 22 is inserted at its lower end portion into the housing 16, and the stem 22 is urged outwardly by a helical compression spring 21. An orifice 23 formed on the side wall of the stem 22 is normally closed or stopped by a stem gasket 24. The orifice 23 is exposed by pushing the stem 22 down into the housing 16 to allow the inside and outside of the housing 16 to communicate through this orifice 23. An inlet 25 is formed on the side wall of the housing 16 and is inserted in the inner bag 10, so that the aerosol content in the inner bag 10 can be introduced into the housing 16.

A cover 26 made of a metallic material, such as stainless steel, is fixed on the upper surface of the annular rib 18 of the housing 16. The cover 26 is tightly fixed onto the outer peripheral surface of the annular rib 18 of the housing 16. The thus fixed cover 26 integrates and immobilizes the helical compression spring 21, stem 22, stem gasket 24, etc. in the housing 16 to facilitate handling of the housing 16 in assembling the aerosol container 27. Meanwhile, the helical compression spring 21, stem 22, stem gasket 24, etc. constitute a valve mechanism 28 of the aerosol container 27.

In order to fabricate the aerosol container 27 thus constituted, the inner bag 10, with or without a content charged therein, is first inserted into the jacket 1 through an opening 29 in an upper end thereof. The inner bag 10 is inserted from the storage section 12 thereof, and the annular packing 8 is allowed to engage with the upper side 7 of the engagement ridge 6 of the jacket 1. In this insertion process, the inner bag 10 pushes the annular packing 8 against the upper side 7 of the engagement ridge 6 to achieve engagement therewith, and the thick flange 13 provided on the inner bag 10 facilitates stable insertion of the inner bag 10 into the jacket 1. Accordingly, the inner bag 10 does not slip off into the jacket 1 or out of position in this stage and cause poor airtightness.

Next, the housing 16, incorporating the valve mechanism 28, is inserted into the jacket 1 through the upper end opening 29 thereof, and the inner frame 17 of the housing 16 is inserted along the side of the inner peripheral surface of the flange 13 of the inner bag 10. Thus, the annular packing 8 and the flange 13 are securely pushed against the inner surface of the jacket 1 to bring the annular packing 8 into intimate contact with the upper side 7. Simultaneously, the gasket 14, placed beforehand on the upper end face of the flange 13 (or the flange 13 made of a soft and elastic material) is brought into contact with the lower surface of the annular rib 18, so that the aerosol content cannot leak upward through the contact section between the inner frame 17 and the inner surface of the inner bag 10. Since the gasket 14 is also brought into contact with the inner peripheral surface of the jacket 1, leakage of the propellant upward beyond the annular packing 8, if any, can be assuredly prevented.

As described above, after the housing 16 is assembled with the jacket 1, the upper end portion 30 of the jacket 1 is folded inwardly to secure the upper surface of the cover 26 thereto, and thus the aerosol container 27 is completely assembled. Next, if the inner bag 10 is not charged beforehand with an aerosol content, the aerosol content can be charged into the inner bag 10 under pressure through the stem 22.

Then, a propellant is charged into the jacket 1 through the charging valve 4 or charging port 5 provided on the bottom plate 2, and the charging port 5 is closed with the charging valve 4, completing production of the aerosol container 27.

Figure 3:
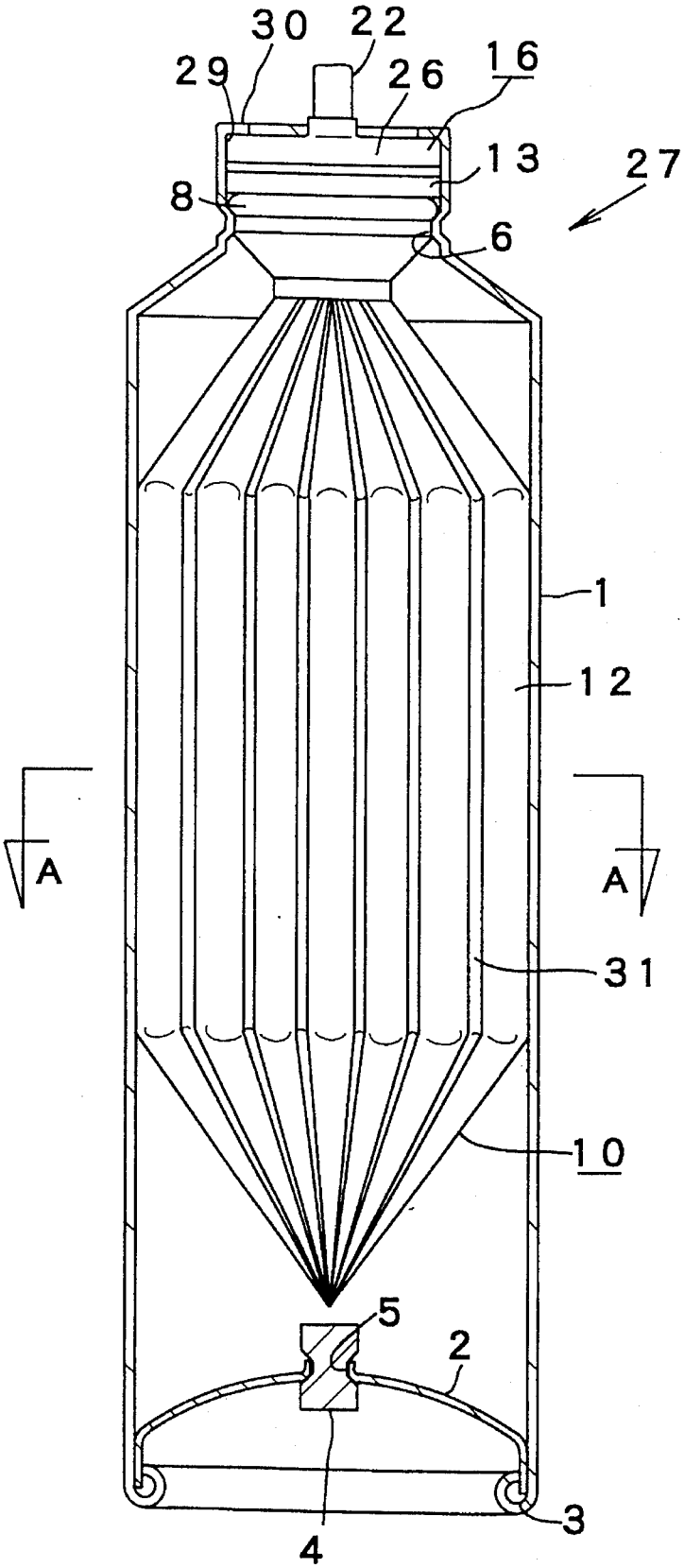
FIG. 3 shows in cross-sectional view, an inner bag having accordion pleats formed radially.
Figure 4:
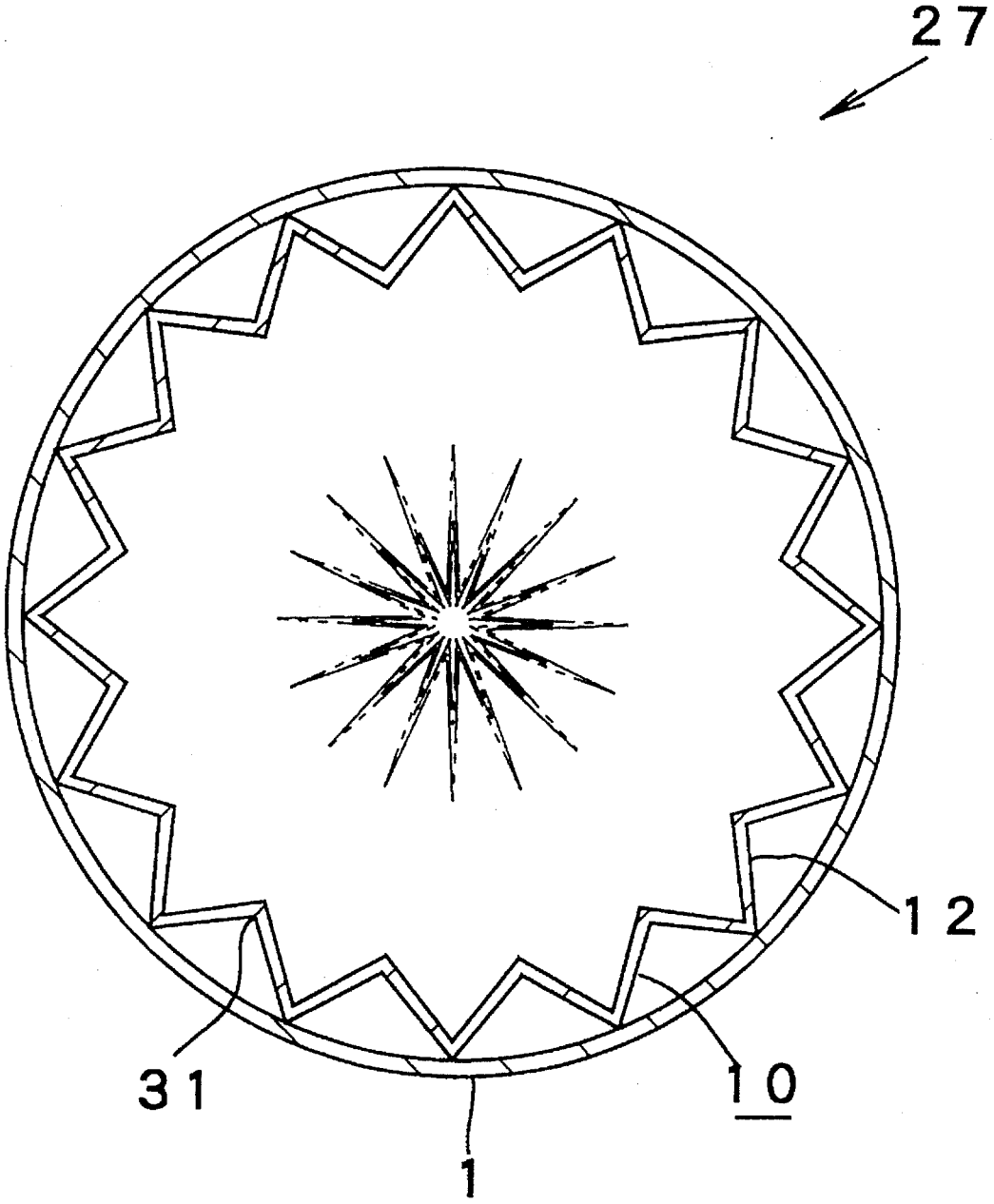
FIG. 4 shows a cross-sectional view taken along the line A—A of FIG. 3.

The inner bag 10 is formed into a generally tubular form using a flat film, an aluminum foil, etc. in the above embodiment. However, according to another embodiment, the inner bag 10 may have a plurality of parallel accordion pleats 31 formed by folding the inner bag 10 vertically along the storage section 12 thereof to be oriented radially, as shown in FIGS. 3 and 4. Thus, by forming the accordion pleats 31 radially along the storage section 12 of the inner bag 10 having a closed bottom, deflation or deformation of the inner bag, which occurs as the aerosol content is sprayed can efficiently be achieved. Therefore the portion of aerosol the content remaining unused in the inner bag 10 can be minimized. That is to say, when the inner bag 10 is allowed to have a simple tubular form, the inner bag 10 is liable to undergo irregular deflation as the aerosol content is sprayed if there is any delicate unevenness in the thickness thereof, causing some portion of the content to remain unused therein. However, by forming accordion pleats radially along the circumference of the storage section 12 of the inner bag 10, as shown in FIGS. 3 and 4 in this embodiment, deflation or deformation of the inner bag 10 can smoothly be achieved even if it has delicate unevenness in the thickness etc. thereof, and thus the content is prevented from remaining unused in the inner bag 10, enabling economical use of the content.

The constitution of the present invention is as described above. Accordingly, a soft inner bag can very stably be attached within a jacket when a double-wall container is to be fabricated. In addition, the inner bag does not slip off into the jacket while the inner bag is being attached. Further, when the double-wall container is used as a final product obtained after completion of assembly, the inner bag does not accidentaly slip off into the jacket to make the content unusable.

What is claimed is:

1. A double-wall aerosol container comprising:

a hollow jacket provided with a charging valve at a bottom of said jacket for charging a propellant into said jacket and also provided with an engagement ridge on an inner peripheral surface of said jacket at an end of said jacket opposite said charging valve, said jacket further including a first annular packing abuttingly engaging an upper side of said engagement ridge;

an inner bag having an open end, said inner bag being provided with a flange formed around said open end of said inner bag, said flange having a second annular packing provided on an upper end face thereof, wherein said inner bag is also provided with a storage section connected to said flange, at least said storage section being deformable by a pressure of the propellant charged in said jacket;

a housing including an inner frame inserted in said open end of said inner bag, and an annular rib protruding radially from said inner frame so as to abut said second annular packing on said upper end face of said flange of said inner bag, said housing also including an aerosol spray valve mechanism, said aerosol spray valve mechanism including a stem portion; and a cover which is fastened to an upper end portion of said jacket for fixing and covering an upper surface of said housing, with said stem portion of said valve mechanism protruding from a center of said cover.

2. The double-wall aerosol container according to claim 1, wherein said inner bag includes an annular groove formed about an outer periphery thereof, adjacent to a lower part of said flange of said inner bag, wherein said first annular packing is received in said annular groove.

3. The double-wall aerosol container according to claim 1, wherein said second annular packing is.

4. The double-wall aerosol container according to claim 1, wherein said storage section of said inner bag has a tubular form.

5. The double-wall aerosol container according to claim 1, wherein said storage section of said inner bag has a plurality of vertically-extending and parallel accordion pleats oriented along a circumference thereof.

* * * * *